US007616109B2

(12) United States Patent
McCulloch et al.

(10) Patent No.: US 7,616,109 B2
(45) Date of Patent: Nov. 10, 2009

(54) SYSTEM AND METHOD FOR DETECTING DETECTOR MASKING

(75) Inventors: Colin S. McCulloch, Alloway (GB); Donna A. Mill, Glasgow (GB); William J. Brown, Glasgow (GB)

(73) Assignee: Honeywell International Inc., Morristown, NJ (US)

( * ) Notice: Subject to any disclaimer, the term of this patent is extended or adjusted under 35 U.S.C. 154(b) by 141 days.

(21) Appl. No.: 11/373,638

(22) Filed: Mar. 9, 2006

(65) Prior Publication Data

US 2007/0210911 A1 Sep. 13, 2007

(51) Int. Cl.
*G08B 29/00* (2006.01)

(52) U.S. Cl. ..... 340/507; 340/541; 340/521; 340/657; 324/555

(58) Field of Classification Search ..... 340/507, 340/541, 511, 521, 567, 506, 522, 552, 554, 340/657; 250/340, 371, 221, 341.1, 341.8; 379/21, 457; 324/555
See application file for complete search history.

(56) References Cited

U.S. PATENT DOCUMENTS 5,193,108 A * 3/1993 Stocklin ..... 379/21
5,578,988 A * 11/1996 Hoseit et al. ..... 340/522
5,675,150 A * 10/1997 Kunz ..... 250/341.1
6,080,981 A * 6/2000 Payne ..... 250/221
6,127,926 A * 10/2000 Dando ..... 340/541
6,191,688 B1 * 2/2001 Sprouse ..... 340/506
6,215,399 B1 * 4/2001 Shpater ..... 340/567

FOREIGN PATENT DOCUMENTS

| | | |
|---|---|---|
| DE | 26 32 738 | 1/1978 |
| DE | 38 42 053 A1 | 6/1990 |
| FR | 2 594 575 | 8/1987 |
| WO | WO 98/21701 | 5/1998 |

* cited by examiner

*Primary Examiner*—Anh V La
(74) *Attorney, Agent, or Firm*—Husch Blackwell Sanders Welsh & Katz

(57) ABSTRACT

A system and method is provided for indicating a masking event using transmission wiring delegated for indicating intrusion and tampering events. The method of indicating a masking event utilizes measurable changes in resistance to indicate the current masking state of a detector. When a detector is not masked, a first resistance value is measurable on the transmission wiring, while when a detector is masked, a second resistance value is measurable on the transmission wiring. The transmission wiring connects the detector to a control unit that executes a security-related response based on the value of the measured resistance.

14 Claims, 3 Drawing Sheets

SYSTEM AND METHOD FOR DETECTING DETECTOR MASKING

I. FIELD OF THE INVENTION

The present invention relates, generally, to security systems, and, more specifically, to a system and method for detecting detector masking in security systems.

II. BACKGROUND OF THE INVENTION

Security systems have steadily increased in complexity over the years, beginning with the simple lock to the modern electronic security systems. Current security systems are not only designed to protect a home or commercial property from unauthorized intrusion but also to provide status of environmental conditions, such as temperature, air quality, fire warnings, carbon monoxide warnings, etc. Such systems include a myriad collection of sensors ranging from video cameras, infrared sensors, motion detectors, pressure sensors, temperature sensors, smoke detectors, and various air quality sensors. These sensors are distributed throughout a property and usually linked to a centralized security monitoring system.

To properly monitor an area, detectors must be appropriately positioned. During installation of a security system, the detectors must be installed at points where they have clear lines of sight so that the detector can efficiently monitor a maximum area. In situations where the area is irregularly shaped or contains objects that can obstruct a detector's field of view, multiple detectors are installed such that their fields of view partially overlap. In this way an area can be effectively monitored and the number of blind spots, i.e., regions in the monitored area that are not within the field of view of any of the detectors, is greatly reduced.

An additional consideration during installation of the detectors is aesthetics. With respect to aesthetics, most people would prefer not to have a plurality of detectors scattered throughout a room in a manner that would detract from the overall appearance of the area. In this regard, manufacturers have designed detectors to be visually appealing or compact so that they are less noticeable. Security system installers also position detectors in areas that draw minimal attention, such as corners or on ceilings or near the floor.

A further consideration is concealment. A detector that is visible to a would-be intruder is easier to defeat than one that is not visible. Often, detectors are installed behind vents or under furniture, thus limiting an intruder's chances of noticing the detector and employing a countermeasure. Consequently, a concealed detector would have a high chance of successfully detecting an intrusion.

However, both the aesthetic and concealment considerations can pose a serious problem during installation and even after installation. The problem in question is referred to as detector masking. Masking occurs when a detector is prevented from operating properly. Detector masking may be caused by any number of reasons, ranging from improper placement of the detector, accidental block of the sensor by an obstructive object, or even an intentional action in an attempt to thwart the detector.

One of the commonly used detectors is the passive infrared (PIR) motion detector. PIR motion detectors are electronic devices used in some security alarm systems to detect motion of an infrared emitting source, usually a human body.

All objects having a temperature above absolute zero (−273.15° C. or −459.67° F.) emit radiation according to the black body radiation model. Much of this radiation is invisible to the human eye, such as infrared radiation, but these invisible wavelengths can be detected by electronic devices designed for such a purpose. In the case of the PIR motion detectors, the wavelengths being detected fall into the infrared band. The PIR does not emit energy of any type but merely passively accepts infrared energy through an opening in its housing. The opening is usually covered with an infrared-transparent (but translucent to visible light) plastic sheet, which may or may not have Fresnel lenses molded into it. This plastic sheet prevents the intrusion of dust and insects while the Fresnel lenses, if present, focus the infrared energy onto the surface of an infrared sensor.

An intruder entering the monitored area is detected when the infrared energy emitted by the intruder is focused onto a section of the infrared sensor, which had previously been viewing at a much cooler part of the monitored area. That portion of the infrared sensor becomes warmer than when the intruder wasn't there. As the intruder moves, so does the hot spot on the surface of the infrared sensor. This moving hot spot causes the electronics connected to the infrared sensor to activate the detection input on the alarm control panel. Conversely, if an intruder were to try to defeat a PIR perhaps by holding some sort of thermal shield between himself and the PIR, a corresponding 'cold' spot moving across the face of the chip will also cause the relay to de-energize—unless the thermal shield has the same temperature as the objects behind it.

Unintentional masking may occur in situations where a piece of furniture or other such obstructive object is placed in front of a PIR motion detector. The PIR motion detector, being so obstructed, is unable to detect any motion. Indeed, since the obstructive object is most likely not to move, the PIR motion detector would not provide any indication of a problem. The PIR motion detector would simply register as no motion being detected.

Additionally, masking may occur due to environmental conditions unrelated to an intrusion. For instance, detectors for sensing temperature differences may be masked if direct sunlight or airflow from a ventilation system impacts the sensor. In such a case, the sensors would provide a false reading and thus not detect an actual temperature change for the coverage area. Thus, PIR motion detectors should not be placed in a location where direct sunlight may impact the infrared sensor, as this would artificially raise the detected temperature across the entire sensor surface such that an intruder's body temperature would be obscured.

A further masking event can be the result of an intruder attempting to defeat the PIR motion detector. While this masking is obviously the most serious, it is highly important to identify all masking situations. In the case of an intrusion, an alarm can be activated. Conversely, in the cases of an environmental condition-related or unintentional masking, the sensor can be repositioned or other action taken to correct the masking issue.

New security system standards include a requirement that detectors provide means for detecting a masking situation and alert a central monitoring unit when such masking occurs.

III. SUMMARY OF THE DISCLOSURE

An object of the present invention is to provide a system for detecting detector masking in a security system.

Additionally, another object of the present invention is to provide detection of detector masking using the same wiring as currently used for existing alarm and tamper functionality.

Accordingly, the above-identified objectives are met by providing a detector for use in a security system. The detector includes an intrusion sensor and a masking detection means. The detector is provided with a connector for coupling the detector to a control unit; and a mask event-sensing component for providing an indicator of a mask state of the detector. The indicator is provided by an electrical resistance measurable at the connector. The resistance is set to a first value when the detector is functioning properly and set to a second value when the detector is determined to be in a masked state.

Furthermore, the above-mentioned objectives are met by a method for providing masking detection in a detector component of a security system. Method includes the step of indicating a mask state of the detector. The indication is an electrical resistance that is set to a first value when the detector is functioning properly and set to a second value when the detector is determined to be in a masked state.

IV. BRIEF DESCRIPTION OF THE DRAWINGS

These and other features, aspects, and advantages of the present invention will become better understood with regard to the following description, appended claims, and accompanying drawings wherein:

V. DETAILED DESCRIPTION OF DISCLOSURE

Figure 1:
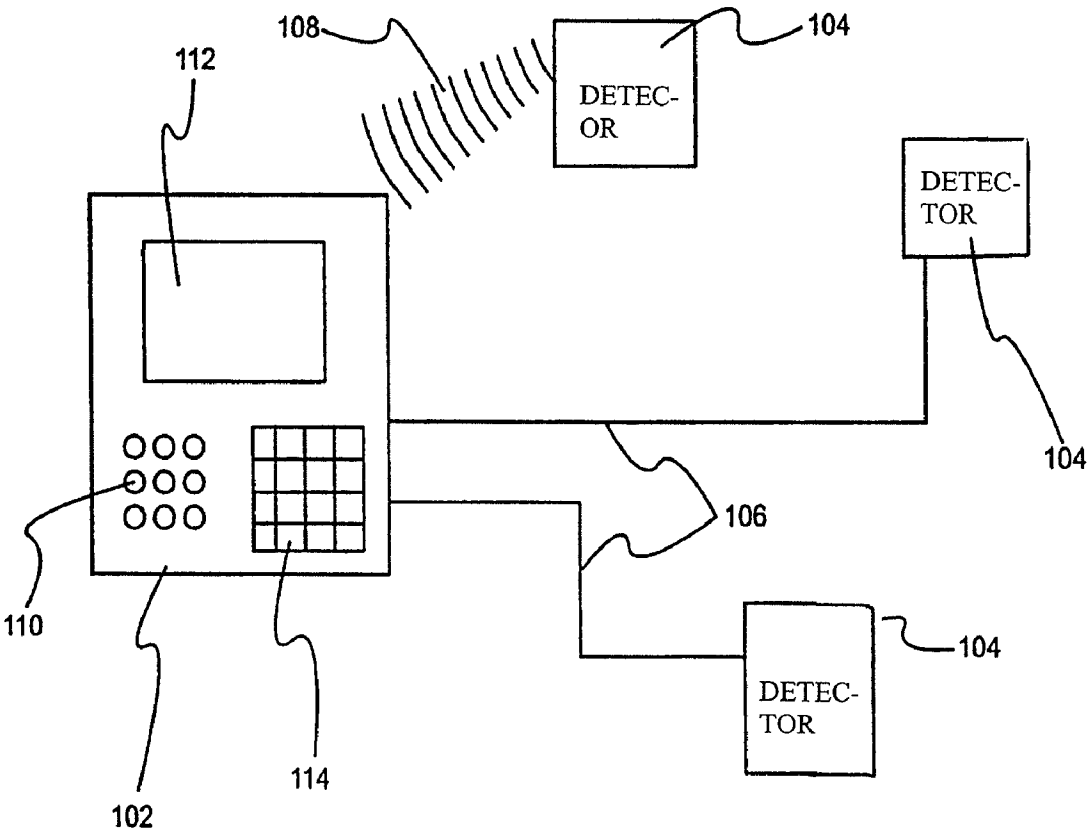
FIG. 1 illustrates a block representation of a security system in accordance with the present invention.

An embodiment of the present invention, as shown in FIG. 1, provides a control unit 102 for managing one or more sensor devices, or detectors, 104, such as, but not limited to, a passive infrared (PIR) motion detector, acoustic sensor, vibration sensor, etc. The control unit 102 allows activation, monitoring and diagnostics of the security system. The security system status may be displayed using a plurality of color-coded light emitting diodes (LEDs) 110, liquid crystal display 112, acoustic tones, or other indicator devices. Management of the security system functions may be controlled by way of a keypad 114 or menu-driven touch screen system (not shown). The control unit 102 receives status information from each sensor device 104 and may transmit various control codes via a wired link 106 or wireless link 108.

Figure 2:
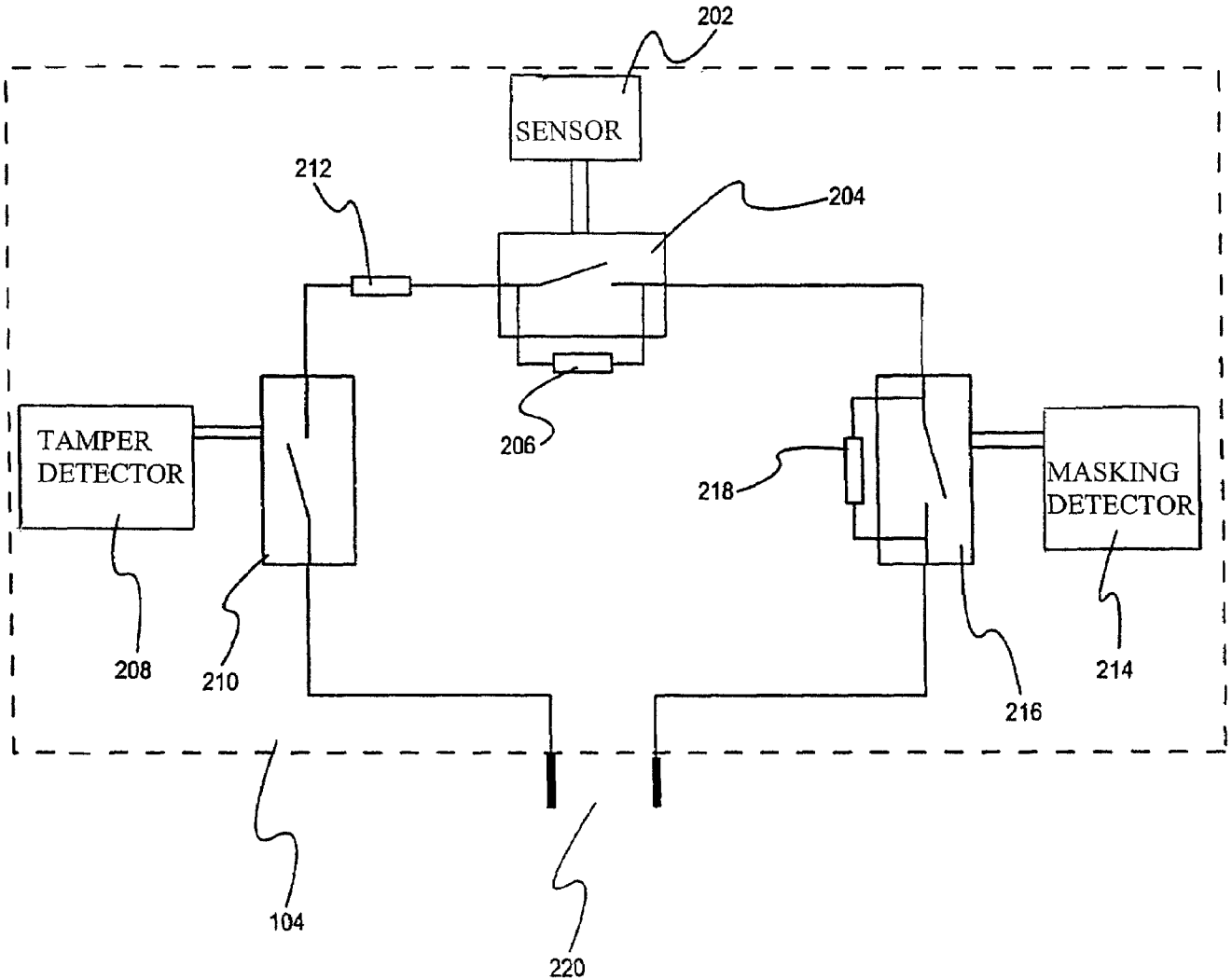
FIG. 2 illustrates a block representation of a detector in accordance with the present invention.

Referring to FIG. 2, the sensor device 104 houses a sensor 202 connected to a first relay 204, a tamper detector 208 connected to a second relay 210, and a masking detector 214 connected to a third relay 216. The relays 204, 210 and 216 are connected serially with conducting material. During normal operation, the relays 204, 210 and 216 are closed, thus allowing electricity to flow through the circuit virtually unimpeded. The resistance measured at the connectors 220, during normal operation, would then be negligibly small, on the order of a few ohms.

However, when any one of the sensor 202, tamper detector 208 or masking detector 214 is triggered, the corresponding relay opens, thus diverting current flow either through one of two resistors 206 and 218 or opening the circuit.

Each resistor has a predetermined and unique resistance value. For example, the resistor 206 corresponding to the sensor 202 may have a resistance value of 500Ω, the resistor 212 providing a load on the circuit may have a resistance value of 5 KΩ, and the resistor 218 corresponding to the masking detector 214 may have a resistance value of 12 KΩ. It should be noted that the resistor values given above are for illustrative purposes only and should not be interpreted as the only values allowable by the present invention. The resistor values selected are preferably grossly different from one another thus preventing possible false readings due to variations in resistance and measurement.

In the above arrangement, it is possible to determine the status of the sensor device 104, whether normal, intruder, tamper, masking, or disconnected, by reading the resistance of the device at the connectors 220. A detector operating normally would have all three relays 204, 210 and 216 closed. With the relay 204, 210 and 216 closed, current flows through resistor 212 but bypasses resistor 206 and resistor 218. Consequently, the circuit exhibits a resistance of 5 KΩ at the contacts 220.

However, if an intruder is detected, relay 204 would be triggered by a signal produced by the sensor 202, opening the relay 204. The open relay 204 causes current to flow through resistor 206, resulting in a resistance of 5.5 KΩ (5 KΩ+500Ω) at the contacts 220.

Alternatively, if a masking event is detected, relay 216 would be triggered by a signal produced by the masking detector 214, opening the relay 216. The open relay 216 causes current to flow through resistor 218, resulting in a resistance of 17 KΩ (5 KΩ+12 KΩ) at the contacts 220.

Further, in the case where a tamper condition is detected, relay 210 opens the circuit thus preventing current flow entirely. Thus, the resulting resistance as measured at the contacts 220 would be infinite.

Figure 3:
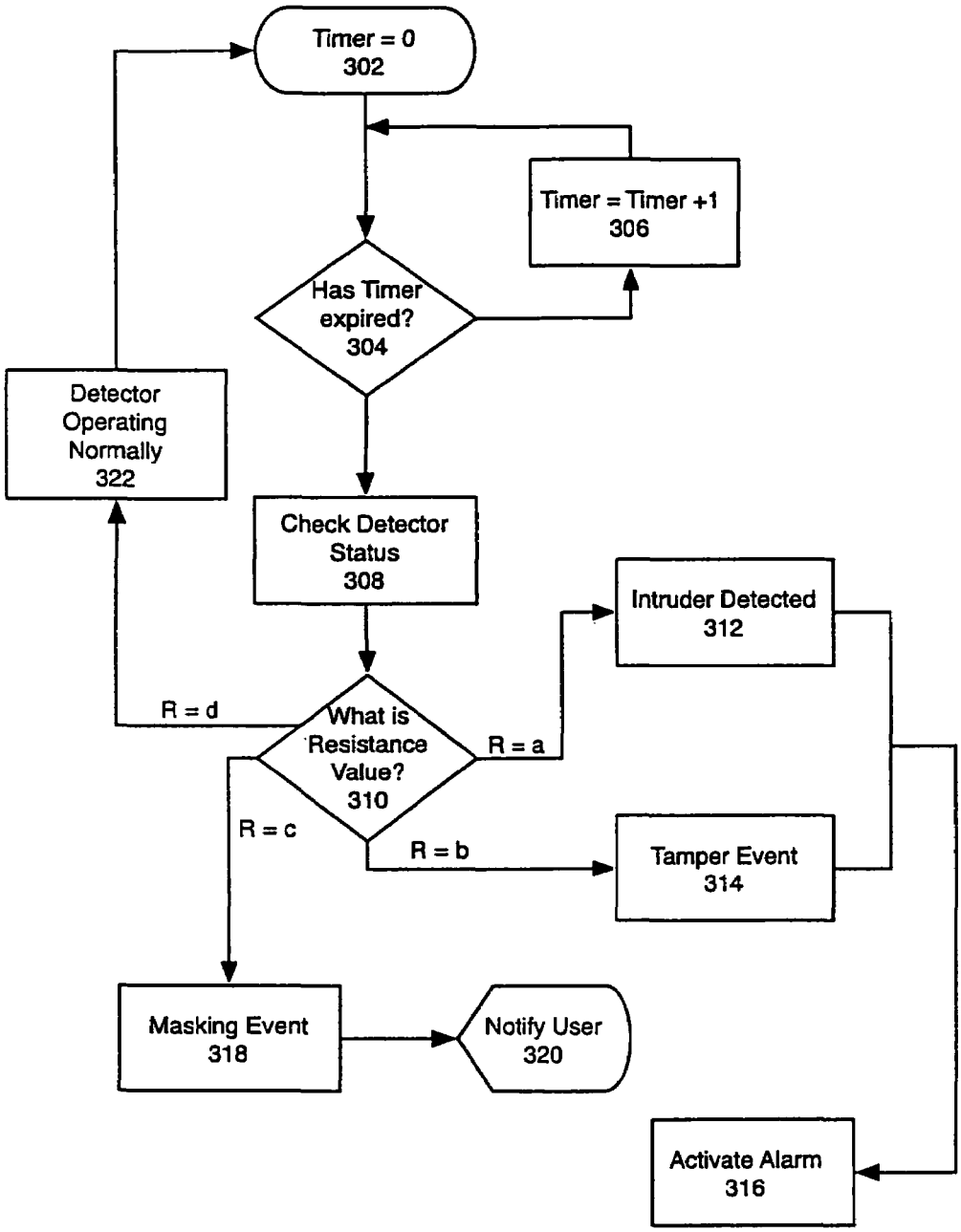
FIG. 3 illustrates a flowchart representing the process of detecting a masking event by a security system, in accordance with the present invention.

Referring to FIG. 3, a process is provided by which a control unit 102 as described in the present invention determines detector status. Beginning with step 302, a timer is set to an initial value, such as zero. Proceeding to step 304, the process determines if a preset amount of time has elapsed. If the preset time has not elapsed, the process proceeds to step 306 wherein the timer is elapsed by a discrete period of time and the process loops back to step 304. This loop continues until step 304 determines that the preset amount of time has elapsed, at which point the process continues on to step 308.

At step 308, the detector status is checked by performing a measurement of the resistance value of the detector 104. In step 310, the resistance value is determined, and based on the resistance value one of three actions is taken. If the resistance value is equal to value a (given the resister values above, value a would be equal to 5.5 KΩ), the process proceeds to step 312 resulting in an intruder detection event. If the resistance value is equal to value b (infinite resistance), the process proceeds to step 314 resulting in a tamper detection event. If the resistance value is equal to value c (17 KΩ), the process proceeds to step 318 resulting in a masking detection event. Finally, if the resistance value is equal to value d (5 KΩ), the process proceeds to step 322 as the detector is operating normally. From step 322, the process loops back to step 302 and the process begins again.

In the case where the process determines that an intruder detection event (step 312) or a tamper detection event (step 314) has occurred, the process continues on to step 316 where an alarm is activated. Additionally, other actions may be taken instead of or in addition to activating an alarm at step 316. For example, an additional action that may be performed at step 316 is initiating a transmission of a notification to a predefined receiving agent such as a remote monitoring station or a police station.

Further, while the procedure provides that both an intruder detection event and a tamper detection event activate an alarm, this is not the only result. Separate actions may be prescribed to each event type. Accordingly, step 316 is intended to incorporate all possible actions that would be appropriate.

Referring to step 318, when a masking detection event has occurred the process provides a notification to a security system operator in step 320. Such a notification can take the form of an audible alert, a readable message on a display screen of the control unit 102 if so equipped, a visual indicator such as a blinking LED, etc.

Additionally, steps 302, 304 and 306 can be omitted. In which case, the process performs the remaining steps continuously and step 322 loops back to step 308 instead of step 302.

The described embodiments of the present invention are intended to be illustrative rather than restrictive, and are not intended to represent every embodiment of the present invention. Various modifications and variations can be made without departing from the spirit or scope of the invention as set forth in the following claims both literally and in equivalents recognized in law.

What is claimed is:

1. A detector for use in a security system, said detector comprising:

a connector for coupling said detector to a control unit; and a mask event sensing component for providing an indicator of a mask state of said detector, said indicator determined from electrical resistance measurable at said connector, said sensing component providing a first mask state indication when said detector is functioning properly with a first resistance value and triggering a notification to a user of a second mask state indication when said detector is determined to be in a masked state with a second resistance value.

2. The detector as in claim 1, further comprising:

an intrusion sensing component having a sensor adapted for detecting intrusion into a predefined area being monitored by said security system, said intrusion sensing component indicating a tamper state by providing a third electrical resistance value measurable at said connector when no intrusion is detected and a fourth electrical resistance value measurable at said connector when tampering is detected; and a housing tamper sensing component having a sensor adapted for detecting tampering with a housing of said detector, said housing tamper component indicating a tamper state by providing a fifth electrical resistance value measurable at said connector when no tampering is detected and a sixth electrical resistance value measurable at said connector when tampering is detected.

3. The detector as in claim 1, wherein said control unit provides a security-related response based on said resistance.

4. The detector as in claim 3, wherein said security-related response including at least one of a visual indicator and an audible indicator.

5. The detector as in claim 1, further comprising a mask event sensor for detecting the occurrence of a mask event, said mask event sensor providing an activation signal to said mask event sensing component when a mask event is detected.

6. A method for providing masking detection in a detector component of a security system, said method comprising:

measuring a resistance of said detector;

indicating a mask state of said detector, said indication based upon the measured electrical resistance, said measured electrical resistance having a first value when said detector is functioning properly and a second value when said detector is determined to be in a masked state;

triggering a notification to a user when said detector is determined to be in the masked state.

7. The method as in claim 6, further comprising:

detecting intrusion into a predefined area being monitored by said security system, an intrusion state is indicated by a third resistance value when no intrusion is detected and a fourth resistance value when tampering is detected; and detecting tampering with a housing of said detector, a tamper state is indicated by a fifth resistance value when no tampering is detected and a sixth resistance value when tampering is detected.

8. The method as in claim 6, wherein said detector is connected to a control unit at a set of contact points, said control unit identifying said resistance value at said set of contact points and providing a security-related response based on said identified resistance value.

9. The method as in claim 8, wherein said security-related response including at least one of a visual indicator and an audible indicator.

10. The method as in claim 6, further comprising detecting the occurrence of a mask event; and providing an activation signal to said mask state indicating step when a mask event is detected.

11. A detector for use in a security system, said detector comprising:

means for coupling said detector to a control unit;

means for determining a electrical resistance of said detector measurable at the coupling means;

means for indicating a mask state based on the resistance determined by said determining means, said means for indicating providing a first indication when said detector is functioning properly with a first resistance value and a second indication when said detector is determined to be in a masked state with a second resistance value; and means for triggering an notification from the means for indicating based on said indicated masking state.

12. The detector as in claim 11, further comprising: means for detecting intrusion into a predefined area being monitored by said security system, said intrusion detecting means indicating an intrusion state by providing a third electrical resistance value measurable at said coupling means when no intrusion is detected and a fourth electrical resistance value measurable at said coupling means when intrusion is detected; and means for detecting tampering with a housing of said detector, said tamper detecting means indicating a tamper state by providing a fifth electrical resistance value measurable at said coupling means when no tampering is detected and a sixth electrical resistance value measurable at said coupling means when tampering is detected.

13. The detector as in claim 11, wherein said control unit provides a security-related response based on said resistance.

14. The detector as in claim 13, wherein said security-related response including at least one of a visual indicator and an audible indicator.

* * * * *

UNITED STATES PATENT AND TRADEMARK OFFICE

CERTIFICATE OF CORRECTION

PATENT NO. : 7,616,109 B2
APPLICATION NO. : 11/373638
DATED : November 10, 2009
INVENTOR(S) : McCulloch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 462 days.

Signed and Sealed this

Nineteenth Day of October, 2010

David J. Kappos

David J. Kappos
*Director of the United States Patent and Trademark Office*